US007213399B2

(12) United States Patent
Dietz et al.

(10) Patent No.: US 7,213,399 B2
(45) Date of Patent: May 8, 2007

(54) REFRIGERATOR COMPRISING A REGENERATOR

(75) Inventors: Holger Dietz, Köln (DE); Heinz-Josef Dubbelfeld, Brühl (DE); Jiri Melichar, Köln (DE); Axel Persch, Köln (DE); Mario Pietrangeli, Hürth (DE); Ernst Schnacke, Köln (DE); André Siegel, Linndau/Bodensee (DE); Axel Veit, Pulheim (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 192 days.

(21) Appl. No.: 10/519,737

(22) PCT Filed: May 13, 2003

(86) PCT No.: PCT/EP03/04980

§ 371 (c)(1),
(2), (4) Date: Dec. 28, 2004

(87) PCT Pub. No.: WO2004/003442

PCT Pub. Date: Jan. 8, 2004

(65) Prior Publication Data

US 2006/0042272 A1 Mar. 2, 2006

(30) Foreign Application Priority Data

Jun. 29, 2002 (DE) ..... 102 29 311

(51) Int. Cl.
*F25B 9/00* (2006.01)

(52) U.S. Cl. ..... 62/6

(58) Field of Classification Search ..... 62/6; 165/168, 170; 60/517, 520, 522, 256
See application file for complete search history.

(56) References Cited

U.S. PATENT DOCUMENTS

| | | | | |
|---|---|---|---|---|
| 3,148,512 | A | 9/1964 | Hoffman et al. | |
| 3,303,658 | A * | 2/1967 | Chellis | 62/6 |
| 3,321,926 | A * | 5/1967 | Chellis | 62/6 |
| 3,355,882 | A * | 12/1967 | Kohler et al. | 60/526 |
| 3,688,512 | A * | 9/1972 | Prast et al. | 62/6 |
| 3,733,837 | A * | 5/1973 | Lobb | 62/6 |
| 4,019,336 | A | 4/1977 | Mijnheer et al. | 62/6 |
| 4,090,859 | A * | 5/1978 | Hanson | 62/6 |
| 4,366,676 | A | 1/1983 | Wheatley et al. | 62/6 |
| 4,761,963 | A * | 8/1988 | Kiese | 62/77 |
| 4,774,808 | A * | 10/1988 | Otters | 60/526 |
| 4,987,743 | A * | 1/1991 | Lobb | 62/6 |
| 5,144,805 | A * | 9/1992 | Nagao et al. | 62/6 |
| 5,398,556 | A | 3/1995 | Lang | 73/863.11 |
| 5,417,071 | A * | 5/1995 | Inaguchi | 62/6 |

(Continued)

FOREIGN PATENT DOCUMENTS

DE 1 277 634 9/1968

(Continued)

*Primary Examiner*—Mohammad M. Ali
(74) *Attorney, Agent, or Firm*—Fay, Sharpe LLP

(57) ABSTRACT

A refrigerator (1) has a housing (2, 14, 19), a cylindrical working chamber (15, 21), a cylindrical displacing member (11, 17), a gap (36, 38) which is located between the housing and the displacing member, a regenerator which is disposed inside the displacing member, and a device alternatingly supplying the working chamber with an effective high-pressure gas and an effective low-pressure gas. In order to overcome the disadvantages associated with gas streams occurring in the gap (36, 38), an additional regenerator (gap gas regenerator), (43) is assigned to the gap (36, 38).

8 Claims, 2 Drawing Sheets

U.S. PATENT DOCUMENTS

| | | | | | |
|---|---|---|---|---|---|
| 5,481,879 | A | | 1/1996 | Asami et al. | 62/6 |
| 5,675,974 | A | | 10/1997 | Heikrodt et al. | 62/6 |
| 5,878,580 | A | * | 3/1999 | Schilling et al. | 62/6 |
| 5,906,099 | A | * | 5/1999 | Jung et al. | 62/6 |

FOREIGN PATENT DOCUMENTS

| | | | | |
|---|---|---|---|---|
| DE | 2 063 555 | | | 7/1971 |
| DE | 24 42 556 | | | 3/1975 |
| DE | 101 12 243 | A1 | | 9/2002 |
| GB | 1335854 | | | 10/1973 |
| GB | 1483356 | | | 8/1977 |
| JP | 8-159585 | A | * | 6/1996 |
| JP | 10-122683 | | | 5/1998 |

* cited by examiner

REFRIGERATOR COMPRISING A REGENERATOR

BACKGROUND OF THE INVENTION

The invention relates to a refrigerator comprising a housing, a cylindrical working chamber, a cylindrical displacing member, a gap which is located between the housing and the displacing member, a regenerator which is disposed inside the displacing member, and a device alternatingly supplying the working chamber with a high-pressure gas and a low-pressure gas.

Refrigerators are low-temperature cooling machines in which thermodynamic cyclic processes take place (c.f. US-PS 29 06 01, for example). A single stage refrigerator comprises chiefly a working chamber with a displacing member. The working chamber is alternatingly connected to a high-pressure and a low-pressure gas source, so that during the forced reciprocating motion of the displacing member, the thermodynamic cyclic process (Stirling process, Gifford McMahon process, etc.) takes place. In doing so, the working gas is guided in a closed circuit. The result of this is that heat is removed from a certain area of the working chamber and the displacing member. Through two-stage refrigerators of this kind and with helium as the working gas, temperatures well under 10° K. can be produced.

A fundamental component of a refrigerator is the regenerator, through which the working gas flows before and after relaxation. The regenerator is commonly disposed within the displacing member substantially of cylindrical design. The regenerator material needs to exhibit, on the one hand, good heat storing properties so that a sufficiently high exchange of heat can take place between the working gas and the regenerator. On the other hand, both the displacing member, in particular the housing of the displacing member, as well as also the cylinder housing need to exhibit poor heat conducting properties, as otherwise the heat removed from the cold side of the working chamber and the displacing member would be replaced rapidly through heat conduction.

It is known to employ as the material for the cylindrical housing, stainless-steel. Stainless-steel exhibits, at the very low temperatures concerned here, a very low heat conductivity. However, stainless-steel as a material is not an option when the refrigerator is employed in the areas of magnetic fields (for example, within nuclear spin tomographs). In such instances the cylindrical housing is made of Novetex (plastic impregnated cotton wool fibre) or materials of similar properties. Novetex is well proven, in particular, as a material for the housing of the displacing member. As regenerator materials, mesh, balls or wool of bronze (preferably for the first stage) and lead balls (preferably for the second stage) are known.

In the instance of the refrigerators of the kind affected here, it is unavoidable that a gas flow is present also in the gap between the housing and displacing member. Said gas flow has also the disadvantageous effect, in that it contributes to the heat exchange between the cold and the warm end of the displacing member. The heat ingress into the expansion chamber (cold end of the working chamber) reduces the performance of the entire refrigerator.

In order to maintain the gas flow through the gap at a lower level compared to the gas flow through the regenerator, the designers of refrigerators of the type affected here have, in the past, employed the approach of designing this gap as narrow as possible, and/or have inserted seals. Measures of this kind are involved and thus costly. This applies in particular to seals which need to fulfil their task at extremely low temperatures. These seals consist commonly of plastic materials which shrink with increasing operating time. Maintaining of close tolerances is not possible.

A refrigerator of the aforementioned type is known from U.S. Pat. No. 5,481,879. For the purpose of reducing the disadvantages involved due to the flow through the gap it is proposed to equip either the outside surface of the displacing member or the inside surface of the housing with one or several helical grooves. Through this measure it shall be achieved that the gases dwell longer within the gap so that an improved temperature equalisation between the flowing gas and the adjacent components takes place. This solution is disadvantageous in that the gap still needs to be relatively narrow in order to achieve a helical gas flow. Moreover, a rapid heat exchange between the gas and the adjacent components does not take place, since these consist of materials which—as already detailed—not only exhibit a low heat conductivity, but also exhibit a very low heat storing capacity.

It is the task of the present invention to create a refrigerator of the aforementioned kind in which the disadvantages due to the gas flows in the gap have been removed.

SUMMARY OF THE INVENTION

Through the measures in accordance with the present invention, the gas flow through the gap is fully regenerated. The regeneration ability of the surfaces encompassing the gap, is created in the instance of a refrigerator in accordance with the present invention by embedding a material having a high thermal capacity within the surfaces encompassing the gap on the outside of the displacing member and/or on the inside of the cylinder housing, for example. The performance of the refrigerator is thus not only improved in that an unwanted heat ingress into the expansion chamber is minimized, but also in that the gas mass flow flowing through the regenerator of the displacing member being, in the instance of the state-of-the-art substantially effective alone, is increased by the regenerated gas mass flow through the gap.

It is expedient to rate the storage ability of the gap gas regenerator such that the gap gas mass flow may increase with increasing operating time of the cold head without impairing the performance of the cold head. The sealing effect between displacing member and cylinder wall is subject, in the instance of a gap gas regenerator, to entirely new operating conditions. In principle, it is unimportant how high the gap gas mass flow is. So much heat is given off to the gap gas, regenerator se that the gap gas mass flow enters into the expansion chamber at substantially the same temperature as that of the expansion chamber. A refrigerator in accordance with the present invention may be designed to be significantly less complex; above all, the seal can be significantly simplified or even omitted. Besides a production with easily to be implemented dimensional specifications, it is in addition possible to fall back on "standard sealing rings". Thus the cooler becomes cheaper, more simple and offers a longer service life.

Especially advantageous is the utilization of the idea in accordance with the present invention in the second stage of a two-stage refrigerator.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
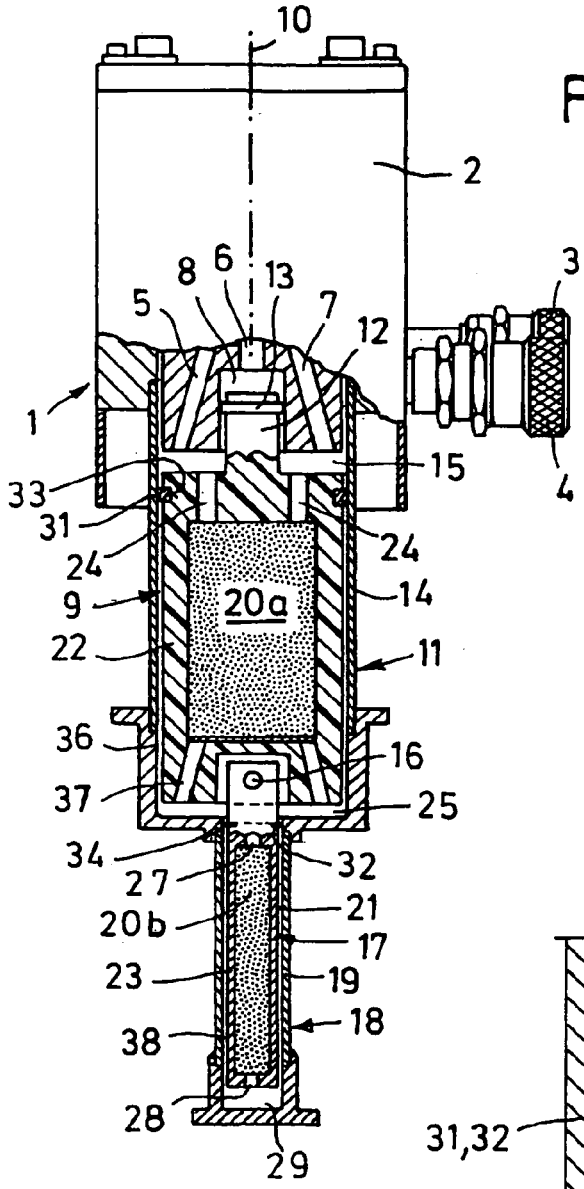
FIG. 1 illustrates a two-stage refrigerator in accordance with the state-of-the-art.

In FIG. 1, a two-stage Gifford McMahon refrigerator 1 according to the state-of-the-art is depicted. In the housing 2 a valve system, not depicted in greater detail, of a basically known design is accommodated. The valve system sequence connects a high-pressure and a low pressure gas source to the connection ports 3 and 4, to the channels 5, 6 and 7. The channel 6 opens out into a cylinder 8 in which there is located a drive piston 12 with the displacing member 9 of the first stage 11 of the refrigerator. Instead of the piston drive also a crank drive may be employed. A ring sealing the piston 12 with respect to the inside wall of the cylinder 8 is designated as 13. With the aid of this drive, the displacing member 9 is reciprocated in the working chamber 15 formed by cylindrical housing 14. Through the pin 16 in the displacing member 17 of the second stage 18 of the refrigerator it is linked to the displacing member 9 of the first stage, such that also the displacing member 17 of the second stage performs a reciprocating motion in the working chamber 21 formed by the cylindrical housing 19. The axis of the entire system is designated as 10.

The displacing members 9 and 17 are of a substantially cylindrical design. Their housings 22 and 23 form hollow chambers 20*a*, respectively 20*b* serving the purpose of accommodating the regenerators. These consist, for example, of bronze mesh in the first stage and lead balls in the second stage.

The working gas is supplied, respectively discharged, through the channels 5 and 7. It flows through the bores 24, through the regenerator of the displacing member 9 and through the bores 37 into the expansion chamber 25 which is the bottom section of the working chamber 15. There the gas expands and removes heat from this area of the first stage 11 of the refrigerator. The pre-cooled gas flows further through the bore 27 in the displacing member 17 of the second stage 18, through the regenerator located in the inside chamber 20*b* of the displacing member 17 and through the bore 28 at the bottom end of the displacing member 17 into the expansion chamber 29 of the second stage 18. There a further expansion is effected having in this area of the second stage a cooling effect. Through the same path the gas flows back and cools the regenerator materials so that the gases flowing in again in the next cycle are already pre-cooled in the regenerator. Sealing rings 31 and 32 which are accommodated in the outside grooves 33 and 34 of the walls of the displacing members serve the purpose of sealing the displacing members 9 and 17 with respect to their related chamber walls 14 and 19. The gaps between the displacing members 11, 17 and the cylindrical housings 14, 19 of the working chambers 15, 21 are designated as 36 and 38 respectively.

Figure 2:
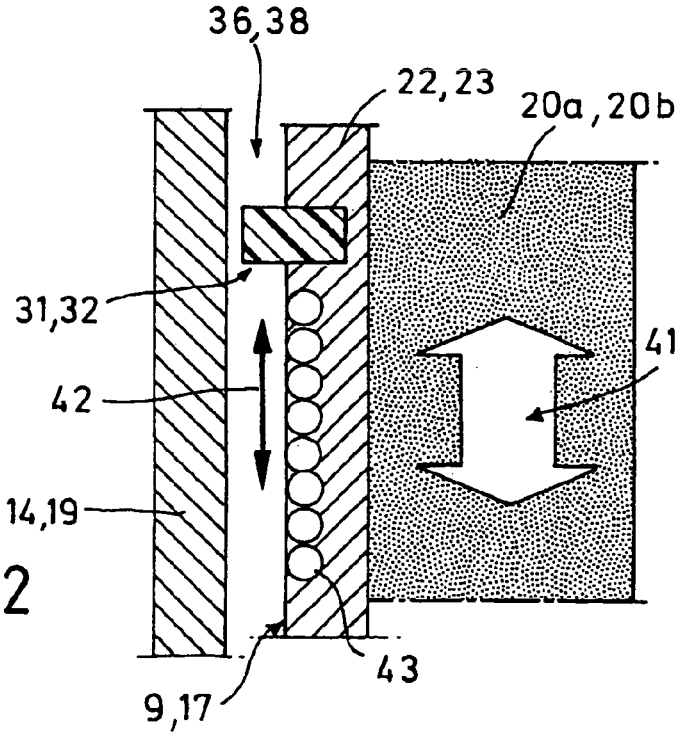
FIG. 2 illustrates a partial sectional view of a gap gas regenerator in accordance with the present invention.

FIG. 2 is a highly schematic partial sketch with a solution in accordance with the present invention which may be employed both in the first and also in the second stage of a refrigerator in accordance with FIG. 1. Through double arrows 41 in the regenerator (in hollow chamber 20*a*, 20*b* of the displacing member 9, respectively 17), respectively 42 (in gap 36, 38) the main gas mass flow and the gap gas mass flow are indicated. To the gap gas mass flow 42 an additional regenerator 43 is assigned. This is a single layer coil extending in the axial direction, being embedded on the gap side in the housing wall 22, 23 of the displacing member 9, 17. In the instance of employing the further generator 43 said coil is constructed in the first stage 9 of bronze wire, for example, and in the instance of being employed in the second stage it is constructed of lead, for example. It is true that also a seal 31, 32 is depicted; but it no longer needs to meet high sealing requirements. It may even be omitted provided it is ensured that the gap gas mass flow is regenerated substantially in its entirety.

Figure 3:
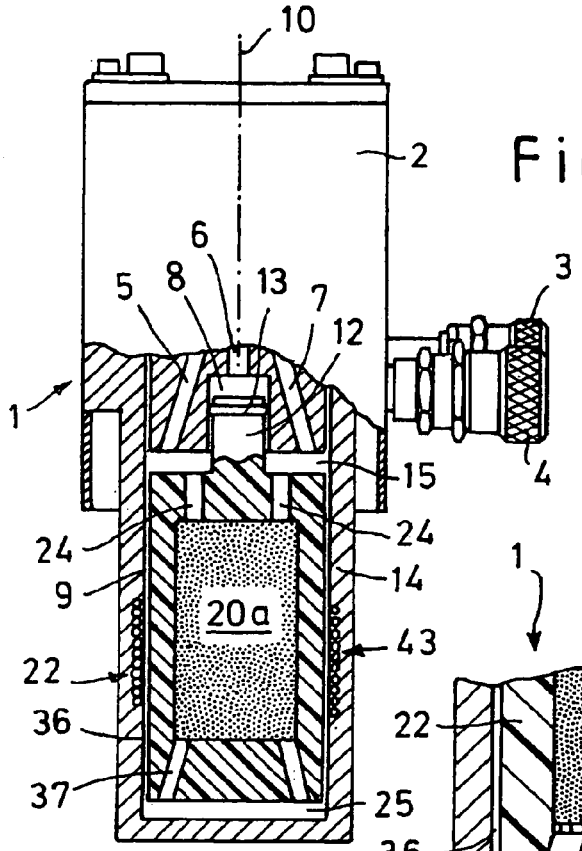
FIG. 3 illustrates a single stage refrigerator designed in accordance with the present inventions.

FIG. 3 depicts a single-flow embodiment of a refrigerator 1. In contrast to the solution in accordance with FIG. 2 the gap gas regenerator 43 is a component of the housing wall 14 of the refrigerator housing. If need be, gap gas regenerators 43 of the kind detailed may also be arranged to both sides of the gaps 36, 38.

Figure 4:
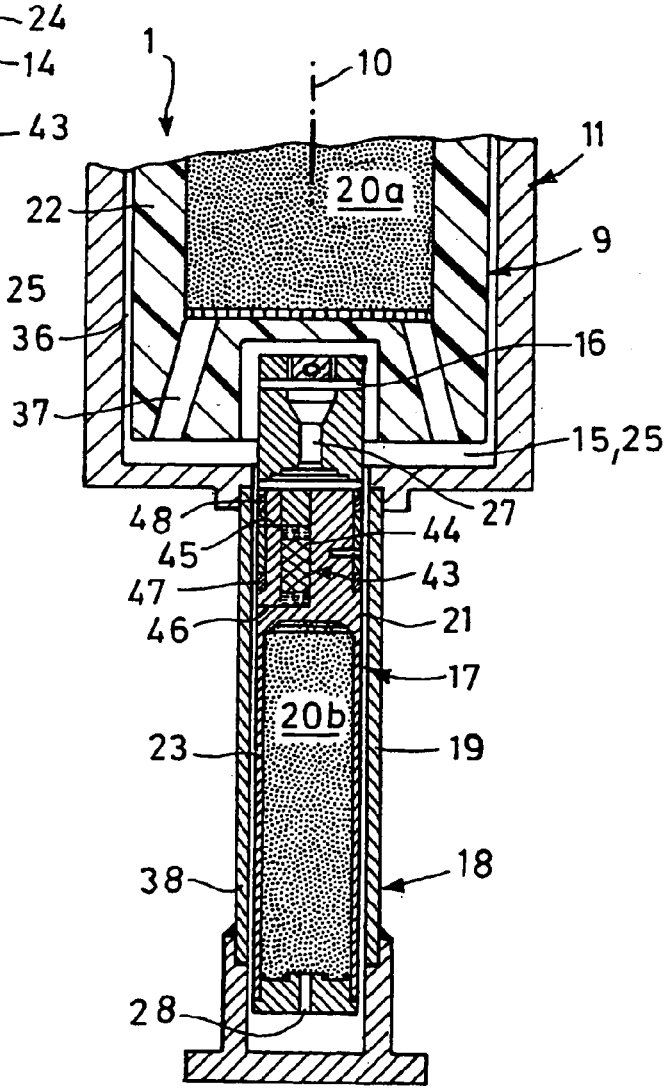
FIG. 4 illustrates a further solution for the design of a gap gas regenerator.

FIG. 4 depicts an embodiment with a gap gas generator 43 which in the depicted embodiment is integrated in the displacing member 17 of the second stage 18, specifically in the area of its warm end. For this purpose in housing 23 of the displacing member 17, a hollow chamber 44 is provided in which the regenerator material is located. Through axially spaced radial bores 45, 46 the hollow chamber 44 is linked on the inlet and at the discharge side to gap 38. Between the openings of the radial bores 45, 46 in the gap 38, there is located a seal 47. This seal too thus also does not need to meet high sealing requirements. It only needs to be ensured that the pressure difference which is created by the seal 47 is greater than the pressure difference created by the regenerator 43. In this manner it is achieved that the gases flowing from the warm side of the displacing member 17 to its cold side through the gap 38 almost entirely flow through the regenerator 43 so that the desired regeneration effect occurs also with respect to the gap gases.

In order to restrict the quantity of the gases flowing through the gap 38, a further seal 48 may be present in gap 38 at the end (warm end). However, in the instance of an optimised design of the flow resistances produced through the seal 47 and the regenerator 43, said further seal can be omitted.

In connection with the solution in accordance with FIG. 4, a further variant is expedient. The chamber 44 may be linked through an approximately axially oriented bore directly to the channel 27. This solution has the effect that the pressure difference across the seal 47 is lower, in particular when bore 45 is eliminated.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A Gifford-McMahon refrigerator comprising:

a housing, a cylindrical working chamber, a cylindrical displacing member, a gap defined between the housing and the displacing member, a first regenerator which is disposed inside the displacing member, a device alternatingly supplying the working chamber with an effective high-pressure gas and an effective low-pressure gas, and a material having a high thermal capacity embedded in at least one surface that defines the gap to define a second regenerator.

2. The refrigerator in accordance with claim 1, further including:

a second stage equipped with a gap gas regenerator.

3. The refrigerator in accordance with claim 1, wherein the second regenerator is accommodated in a hollow chamber which is located in a housing of the displacing member.

4. The refrigerator in accordance with claim 3, wherein the second regenerator is disposed in a hollow chamber in an area of a warm end of a displacing member of a second stage.

5. The refrigerator in accordance with claim 4, further including;

space radial bores extending between the hollow chamber and the gap; and, a first seal extending into the gap between the bores.

6. The refrigerator in accordance with claim 5, further including:

a further seal located relative to the first seal at the warm end of the second stage displacing member.

7. A refrigerator comprising:

a housing, a cylindrical working chamber, a cylindrical displacing member, a gap defined between the housing and the displacing member, a first regenerator which is disposed inside the displacing member, a device alternatingly supplying the working chamber with an effective high-pressure gas and an effective low-pressure gas, and a gap gas regenerator disposed in thermal communication with the gap, the gap gas regenerator including a single layer wire coil extending in the axial direction, said coil being arranged on a side of the gap in a wall of one of the displacing member and the refrigerator housing.

8. A refrigerator comprising:

a housing, a cylindrical working chamber, a cylindrical displacing member, a gap defined between the housing and the displacing member, a first regenerator which is disposed inside the displacing member, a device alternatingly supplying the working chamber with an effective high-pressure gas and an effective low-pressure gas, a gap gas regenerator disposed in thermal communication with the gap, the gap gas regenerator being accommodated in a hollow chamber which is located in a housing of the displacing member, the hollow chamber being linked to the gap through axially spaced radial bores and a seal located between the radial bores such that pressure drop across the seal is greater than a pressure drop across the gap gas regenerator.

* * * * *